United States Patent [19]

Carlson

[11] 4,094,123

[45] June 13, 1978

[54] METHOD AND APPARATUS FOR THE ALIGNMENT OF ELONGATED ARTICLES

[75] Inventor: Bayard L. Carlson, Wilsonville, Oreg.

[73] Assignee: Amfac Foods, Inc., Portland, Oreg.

[21] Appl. No.: 774,804

[22] Filed: Mar. 7, 1977

[51] Int. Cl.[2] ..... B65B 1/22; B65B 35/56

[52] U.S. Cl. ..... 53/24; 53/126; 53/167; 198/382; 198/631; 198/752; 221/200

[58] Field of Search ..... 53/24, 59 W, 126, 167; 198/382–384, 425, 492, 631, 633, 752; 221/200

[56] References Cited

U.S. PATENT DOCUMENTS

| | | | |
|---|---|---|---|
| 2,236,890 | 4/1941 | Bower et al. | 53/126 |
| 2,632,588 | 3/1953 | Hoar | 221/200 X |
| 2,732,163 | 1/1956 | Senzani | 198/633 X |
| 2,983,088 | 5/1961 | Stoeckel et al. | 53/126 X |
| 3,056,485 | 10/1962 | Liberty | 53/126 |
| 3,545,589 | 12/1970 | Keller | 221/200 X |
| 3,668,939 | 6/1972 | Schrader | 198/752 X |
| 3,817,370 | 6/1974 | Cox | 198/382 X |

FOREIGN PATENT DOCUMENTS

| | | | |
|---|---|---|---|
| 1,144,641 | 2/1963 | Germany | 53/126 |

*Primary Examiner*—Robert Louis Spruill
*Attorney, Agent, or Firm*—Klarquist, Sparkman, Campbell, Leigh, Hall & Whinston

[57] ABSTRACT

An apparatus and process for aligning elongated articles is disclosed. A plurality of barrier surfaces are positioned transversely to the longitudinal axis of a vibratory trough through which said articles are moved. The surfaces may comprise gates, which are moved between opened and closed positions at timed intervals so that batches of the articles are alternately bunched up behind a closed gate and dispersed as they move through the trough, or may alternatively comprise cleats on a movable belt. An increased degree of parallel orientation occurs each time a batch of articles contacts a barrier surface.

36 Claims, 9 Drawing Figures

FIG. 2
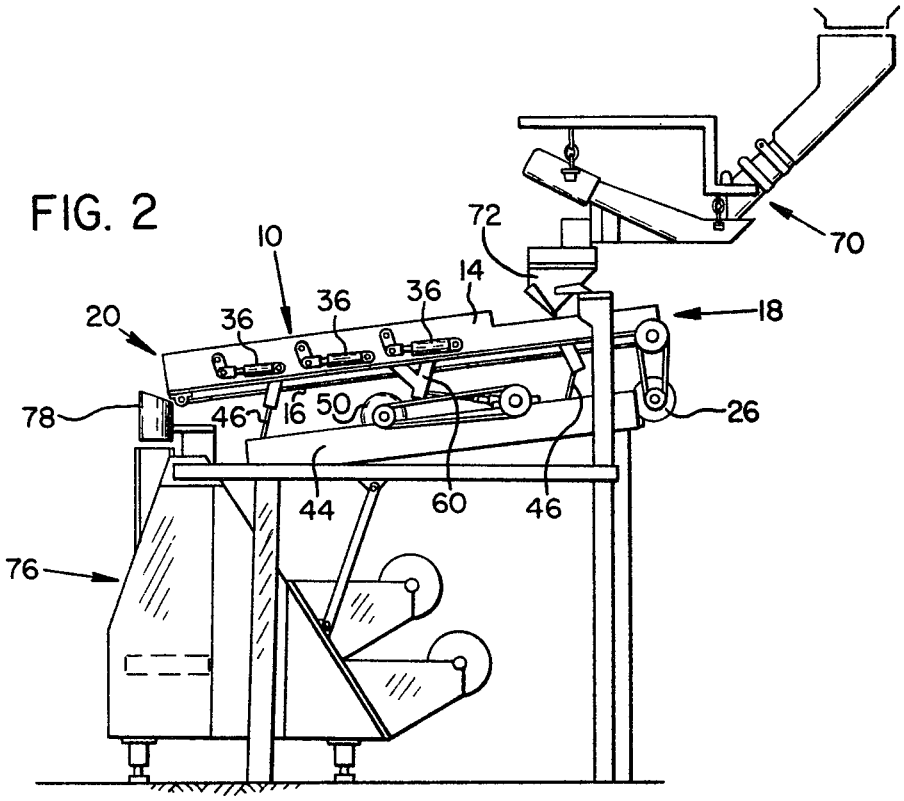
FIG. 5
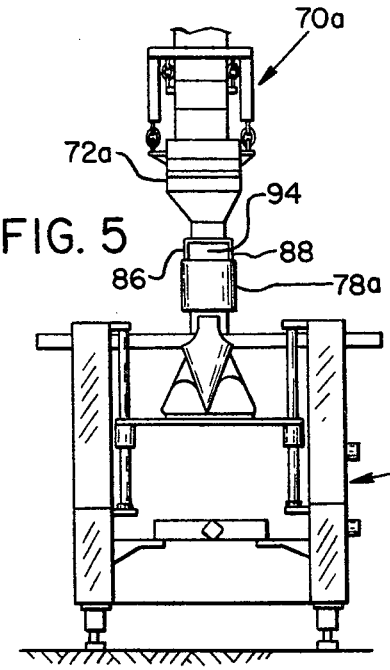
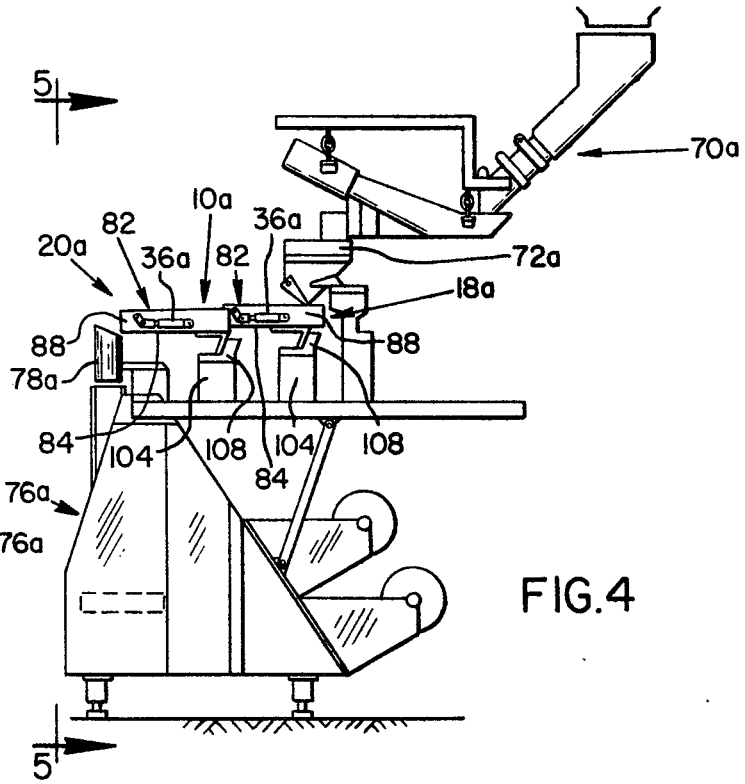
FIG.4

METHOD AND APPARATUS FOR THE ALIGNMENT OF ELONGATED ARTICLES

BACKGROUND OF THE INVENTION

This invention relates to devices for packaging elongated articles and more specifically to devices for aligning elongated articles, such as frozen french fries, in a parallel orientation prior to packaging.

In the past, it has been the common practice to package elongated frozen food particles, such as french fries, in randomly oriented batches of uniform weight. This method of packaging is both wasteful of packaging materials and potentially damaging to those elongated articles which are frangible. When packaged in a random orientation, elongated articles are routinely subject to settling during transit. If packages containing the articles are made of a flexible material, the packages may collapse as the articles settle. When several such packages are included in a rigid walled shipping container, collapse of the packages allows air cavities to develop between the packages and walls of the container. As a result, the packages can move about inside the rigid container so that normal jolts which occur during shipping cause an unnecessarily large number of potentially damaging impacts between the packages and the container walls. Even if the packages are not collapsible, settling increases the potential for product damage because air spaces develop within such packages allowing the articles room to move about.

One way to eliminate settling is to align the articles in a parallel orientation prior to packaging; and attempts have been made to provide apparatuses to accomplish such an alignment. As an example, U.S. Pat. No. 2,732,163 to Senzani shows a packaging system which maintains spaghetti in a parallel orientation. Apparatuses of this type are expensive, highly complex and can be used economically only if parallel alignment of a particular product is absolutely essential.

SUMMARY OF THE INVENTION

The present invention comprises a process and a simple, inexpensive apparatus for aligning elongated articles, such as frozen french fries, in substantially parallel orientation. The apparatus includes a trough divided into a plurality of components by transversely positioned barriers against which the articles collide as they move through the trough. It is easy to clean and to operate; and it can accommodate large volumes of elongated articles in a continuous process.

An important feature of the present invention is its ability to process multiple uniformly weighed batches simultaneously in a single trough.

An object of this invention is to provide an alignment apparatus which can continuously process batches of frozen french fries at a high rate of speed.

A further object is to provide an apparatus which conserves wrapping materials and reduces settling in product packages by substantially aligning elongated articles in parallel orientation prior to the wrapping thereof.

Another object is to provide an alignment apparatus which operates automatically with substantially no operator supervision.

A further object is to provide an alignment apparatus which is of simple construction and which can operate continuously for long periods of time without maintenance.

These and other objects will be apparent from the following detailed description which proceeds with reference to the accompanying drawings.

BRIEF DESCRIPTION OF THE DRAWINGS

In the drawings:

FIG. 2 is a side elevation of the same apparatus shown in reduced scale;

FIG. 4 is a side view of a first alternative embodiment of the apparatus shown in FIGS. 1 and 2;

FIG. 5 is an end view of the embodiment shown in FIG. 4;

DESCRIPTION OF THE PREFERRED EMBODIMENTS a. Movable Gates

Figures 1, 3, 9:
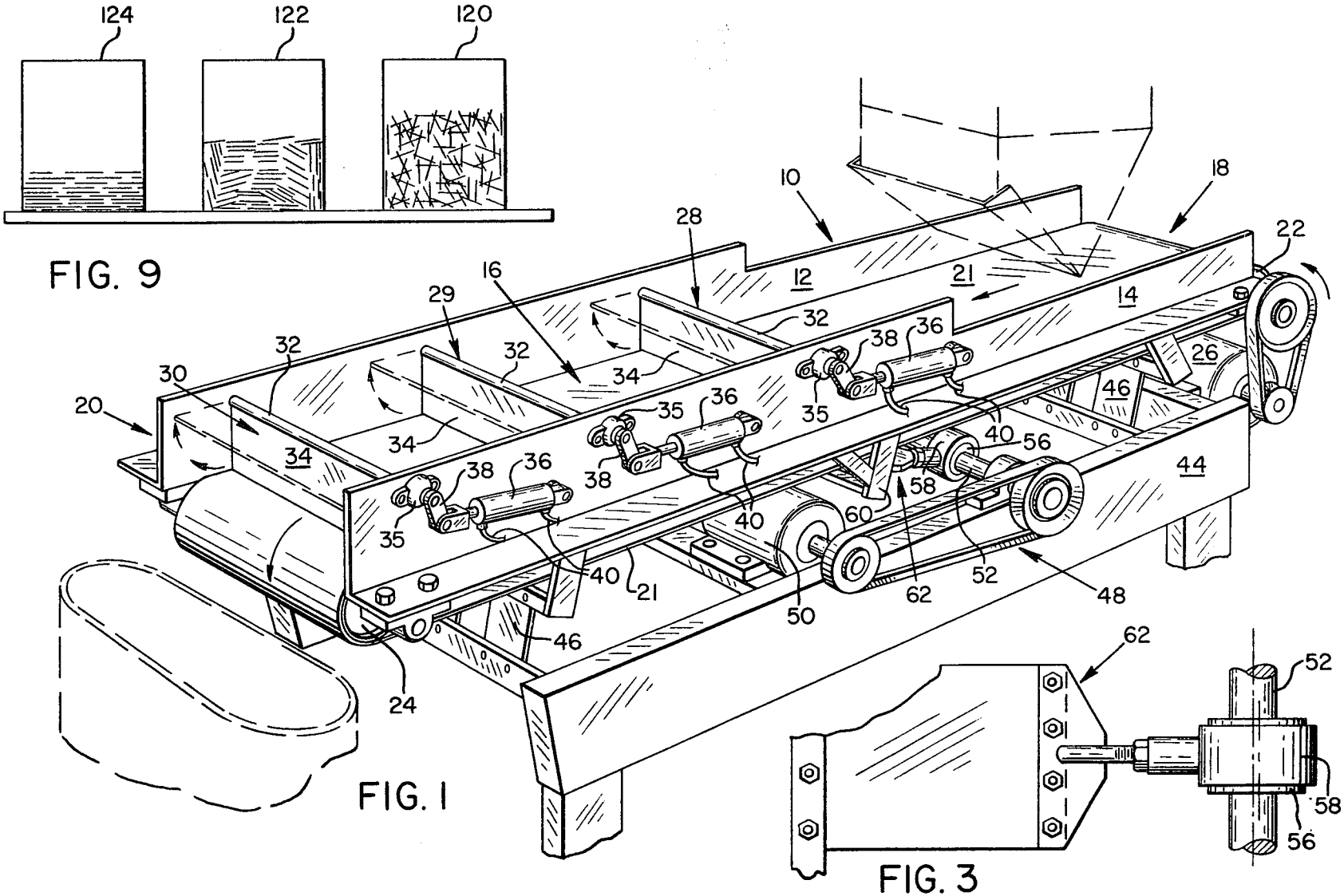
FIG. 1 is a perspective view of an alignment apparatus according to the present invention.
FIG. 3 is a partial top view showing an eccentric drive unit associated with the apparatus shown in FIGS. 1 and 2.
FIG. 9 is a schematic view showing three equally weighted batches of elongated articles in three identical containers.

Referring to FIGS. 1 thru 3, one preferred embodiment of the present invention includes a processing trough 10 for receiving elongated articles to be aligned. The trough has two opposed side walls 12, 14, a floor 16, a first or upstream end 18 and a second or downstream end 20. In the embodiment of FIG. 1 the floor 16 is a continuous belt 21 which is carried by rollers 22, 24. The roller 22 is driven by a motor drive means 26 which is operable to cause the belt 21 to move through the trough from the upstream end 18 toward the downstream end 20 as shown by arrows in FIG. 1. The belt 21 thus serves as a propulsion means for feeding articles longitudinally through the trough 10 toward the downstream end 20. The trough may be inclined uphill at a small angle, but is preferably inclined downwardly, at an angle of up to thirty degrees toward the downstream end 20 so that the force of gravity will aid in moving the articles. The best results are obtained at an inclination of about 7.5°.

The trough 10 is divided into a plurality of compartments by a series of gates 28, 29, 30, each of which is mounted transversely to the longitudinal axis of the trough 10. As articles are moved through the trough they strike these gates and are thereby turned perpendicular to the trough axis. A series having only one gate would substantially improve the alignment of elongated articles, but a series containing three or more gates is preferred because contact with each gate in a series further improves article alignment and because a trough with multiple gates can be used to simultaneously process multiple batches of articles.

The gates are independently movable between a closed position, shown by solid lines in FIG. 1, and an open position, shown by broken lines. When closed, a gate is a barrier which prevents longitudinal movement of articles through the trough. When opened, articles can move beneath it through the trough 10. Each gate comprises a shaft 32 extending transversely to the longitudinal axis of the trough 10 and a flap 34 depending from the shaft and positionable to form a wall or barrier across the trough. Opposite ends of the shafts 32 extend through bearings 35 which are mounted on the side walls 12, 14.

The gates 28, 29, 30 are moved between the closed and open positions by means of pneumatic or hydraulic cylinder and piston actuators 36 which are connected to the shafts 32 by lever arms 38. It is preferred that separate actuators be associated with each of the gates so that each gate may be moved independently of the others. The actuators are connected, via lines 40, to conventional, programmable sequencing means (not shown).

The preferred embodiments of the present invention also include an oscillator means for shaking the floor 16 of the trough 10. In the embodiment of FIGS. 1–3 the oscillator means comprises a support base 44, a plurality of legs 46 connected at one end to the trough 10 and at the other end to the base 44, and reciprocating drive means 48 to move the trough 10 back and forth in a vertical plane parallel to the longitudinal trough axis. The legs 46 may be pivotally mounted at each end to allow motion of the trough 10 relative to the base 44 or, as shown in FIGS. 1 and 2, the legs may comprise flexible legs which are rigidly mounted at each end but which themselves can bend to allow such motion.

The reciprocating drive means 48 preferably includes a motor 50 mounted on the base 44. The motor rotates a shaft 52 on which a circular cam 56 is eccentrically mounted. The cam 56 is contained within a circular yoke 58 connected to the side walls 12, 14 by a mounting bracket 60 and a connecting rod mechanism 62. The shaft 52 is rotated rapidly in the direction shown by the arrows in FIG. 1 so that the trough is first lifted and moved to the left and then lowered and moved to the right in a continuous oscillating movement. This oscillation ballistically propels articles in the trough 10 by lifting and then throwing them toward the downstream end 20. Thus, the oscillator means serves as a propulsion means for moving the articles longitudinally through the trough.

To obtain the desired ballistic propulsion, the eccentricity of the cam 56 should approximately correspond to the cross-sectional diameter of the articles being oriented. Eccentricities less than this amount are not highly efficient in moving the articles and eccentrics substantially greater produce oscillations which tend to disorient the articles as they move between the gates or to throw the articles out of the trough. As an example, if the elongated articles to be processed are frozen french fries having an average cross-sectional dimension of between 0.25 and 0.31 inches, an eccentricity of between 0.12 and 0.50 inches would be suitable for moving the articles, an eccentricity of about 0.31 inches being preferred.

The oscillator means not only propels articles through the trough, but also serves an important alignment function during operation of the apparatus. When multiple articles moving through the trough stack up behind a barrier gate, a portion of the articles become logjammed and are thus prevented from moving into parallel alignment with the gate. Even after the gate is opened to allow the articles to pass downstream, the articles remain substantially bunched together. This problem of logjamming is reduced, however, by the ballistically propulsive motion imparted by the oscillator. The motion causes the articles to spread or disperse longitudinally as they move between gates, but does not substantially alter their angular orientation. Because they are dispersed, the unoriented articles of a batch more easily can turn into the desired parallel orientation when they eventually contact the next downstream barrier gate.

Referring now to FIG. 2, the preferred apparatus of the present invention is shown in its normal operating environment. A dump scale 70 of conventional design is shown positioned over the upstream end 18 of the trough 10. The scale 70 includes a hopper 72 which is positioned to drop articles on the floor 16 of the trough. The scale 70 deposits uniformly weighed batches of articles on the floor 16 in response to signals from the previously mentioned sequencing means.

Also shown in FIG. 2 is a packaging means 76, such as a Model K, Series 10,000 vertical form and fill machine produced by Mira-Pak, Inc. of Houston, Texas. The packaging means 76 is positioned below a container 78 at the downstream end 20 of the trough 10. Aligned articles leaving the trough 10 at the downstream end 20 collect in the container 78 and are thereafter received by the packaging means 76 which separately wraps each batch. Preferably the container has one short and one long interior horizontal dimension and is positioned with the long dimension parallel to the gates. By this arrangement articles of a batch are maintained in parallel alignment until received by the packaging machine. Additional alignment is achieved by providing an oscillator to vibrate the container 78 and thus cause settling. To insure the accuracy of batch weights, a dribble feed mechanism (not shown) may optionally be installed at the downstream end of the trough and the container 78 associated with a check weigher.

As will be readily understood to a person skilled in the art, movable gate embodiments of the present invention can take a variety of different forms. For example, the floor 16 may comprise a rigid platform mounted between the side walls 12, 14 and connected to an oscillator means which serves as the sole propulsion means to move articles longitudinally through the trough from the upstream end 18 toward the downstream end 20.

Another movable gate embodiment is shown in FIGS. 4 and 5. In this embodiment the trough **10*a* comprises a series of trough segments 82, each of which includes a rigid floor and side walls 86, 88. The segments are positioned in a stairstep arrangement with the highest trough segment being positioned adjacent the upstream end 18*a*. Each of the floor segments 84 is preferably inclined downwardly from such upstream end 18*a* toward the downstream end 20*a* to facilitate movement of the articles in the trough 10*a* toward the downstream end 20*a*. A gate 94 is positioned in each of the trough segments 82 at a point near the lower end thereof. The preferred gate actuation means are of the type previously described, including shaft bearings on the side wall segments 86, 88, actuators 36*a***, and lever arms joining the shafts and pistons.

Preferably the trough segments 82 are each connected to and oscillated by independent oscillators which serve as the article propulsion means. In FIG. 4 two oscillators are shown linked respectively to two trough segments 82. Each of these oscillators includes a support base 104 mounted in a fixed position and a reciprocating drive mechanism 108 operable to move the trough segments 82 back and forth in relation to their respective support bases 104. Scale means 70*a* and packaging means 76*a* are identical to the similarly denominated structures previously described in conjunction with FIG. 2.

b. Cleated Belts

Figure 6:
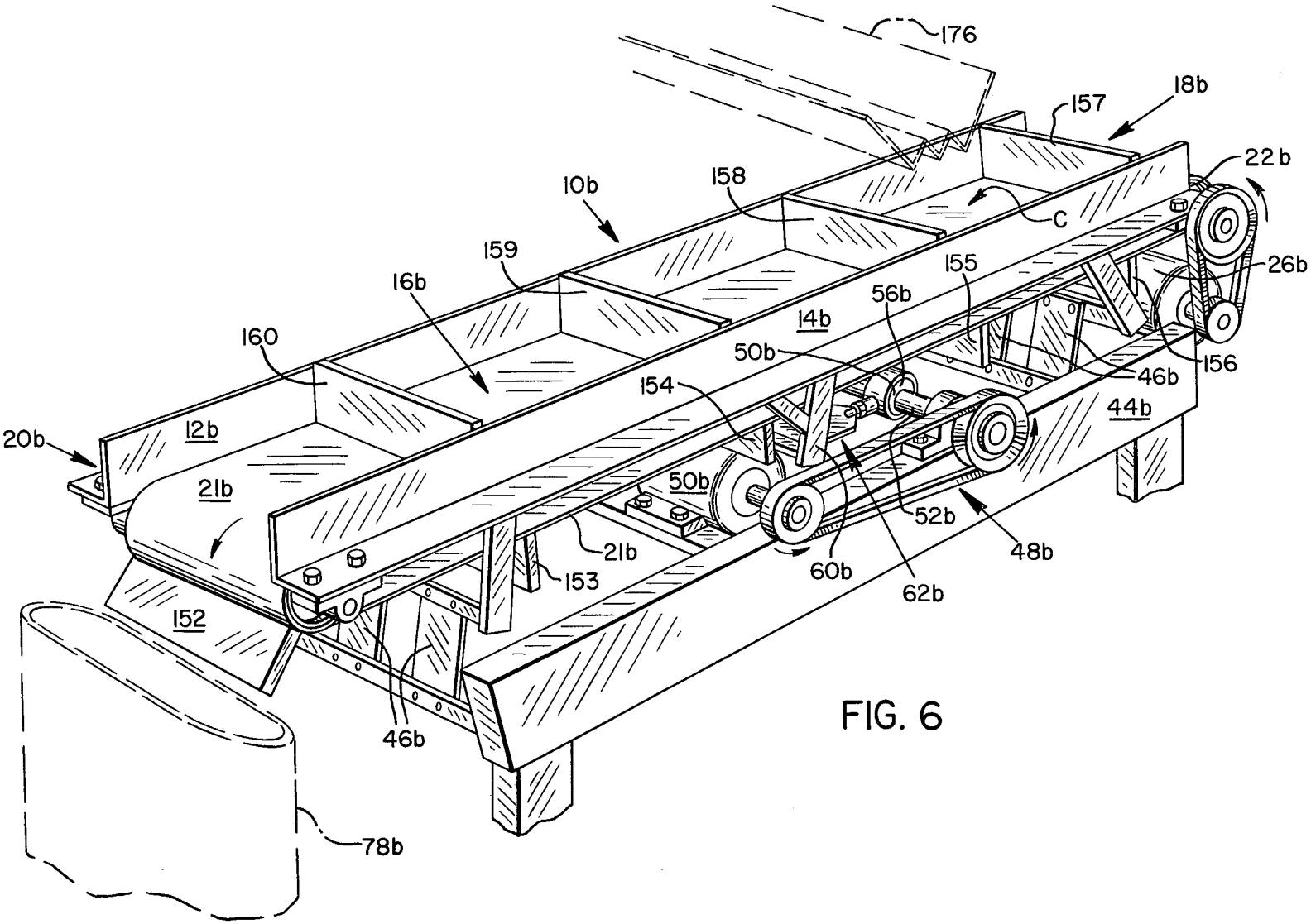
FIG. 6 is a perspective view of a second alternative embodiment of the apparatus shown in FIGS. 1 and 2.
Figure 7:
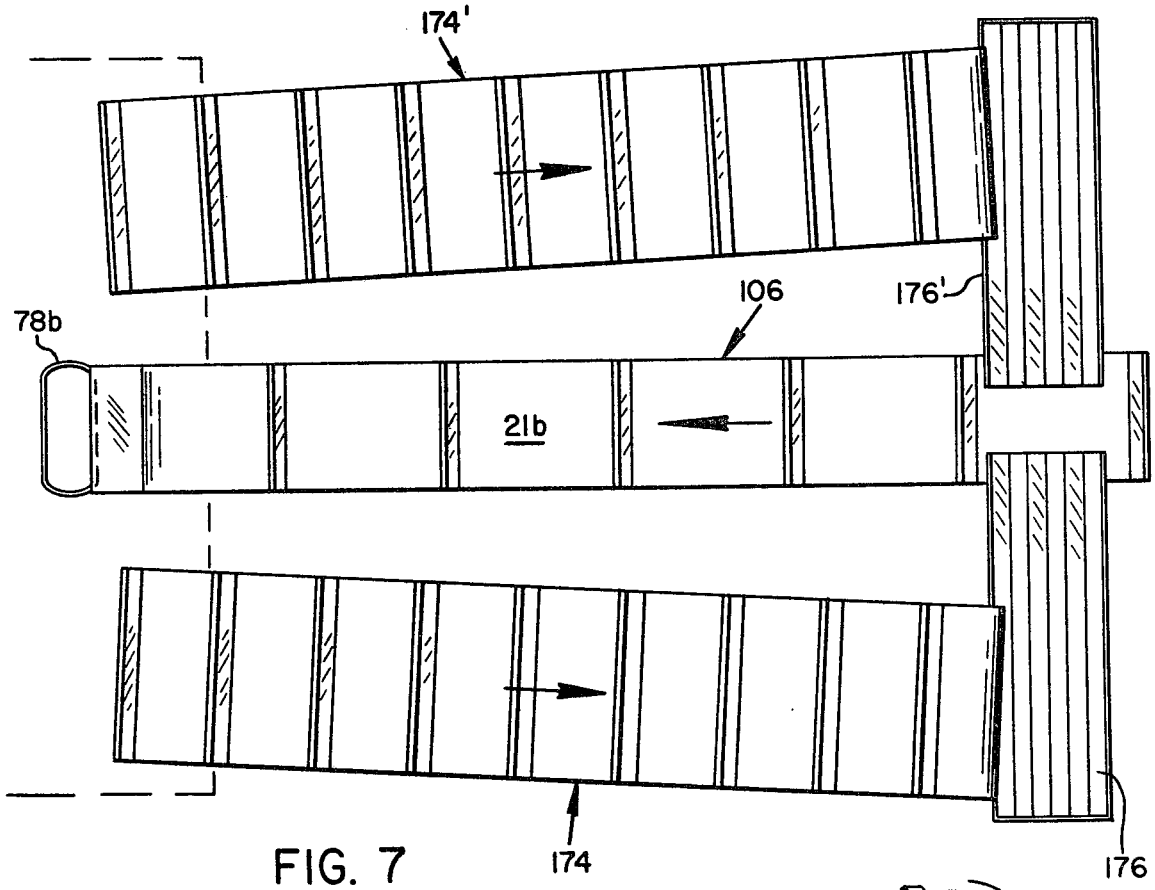
FIG. 7 is a schematic top view of the apparatus shown in FIG. 6 and a feed mechanism for use with an alignment apparatus according to the present invention.
Figure 8:
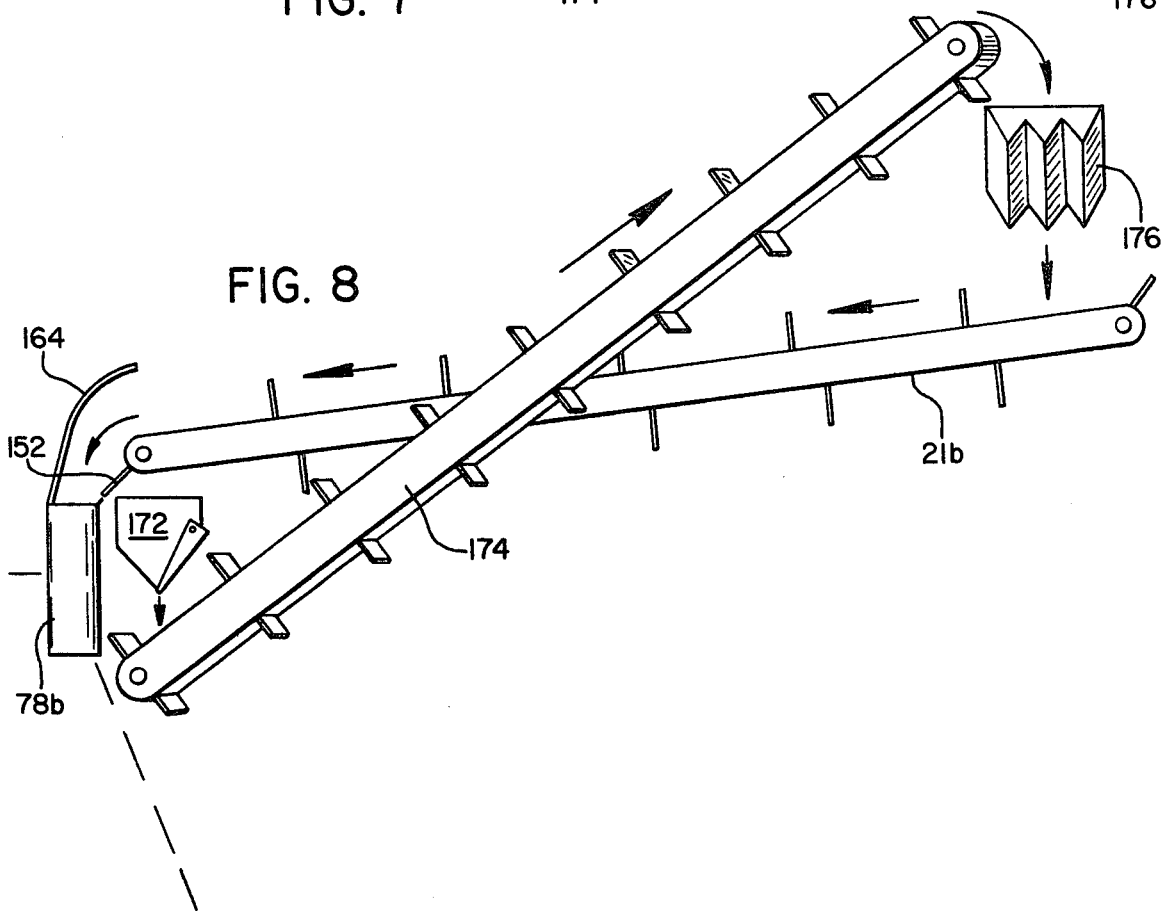
FIG. 8 is a schematic side elevation of the apparatuses shown in FIG. 7.

FIGS. 6 to 8 show yet an additional embodiment of the present invention. In this embodiment the floor 16*b* of the trough is a movable belt 21*b* similar to the moving belt of the embodiment shown in FIG. 1. The embodiment of FIG. 6 differs from the previously described embodiments in that it includes no movable gates but rather includes a series of cleats 152–160 which are mounted on the belt and which extend transversely to the longitudinal axis of the trough 10*b*. Those cleats which extend upwardly from the belt (157 through 160 in FIG. 6) define a plurality of compartments in the trough 10*b* and provide barrier surfaces against which the articles collide and are aligned as they move through the trough. The compartments move from the upstream end 18*b* toward the downstream end 20*b* of the trough 10*b* as the belt travels therethrough.

It is an important feature of this cleated-belt embodiment that articles to be aligned always remain within one compartment and that each compartment has a fixed position on the belt 21*b*. This is advantageous because a rapidly moving belt, of the type used in the embodiment of FIG. 1, projects the articles against a fixed gate and thereafter continues to move and thereby possibly abrade the articles which are held in place by the closed gate. The cleated-belt embodiment is also advantageous in that it can be used to simultaneously process a relatively large number of batches. This is because each batch is maintained in its own separate compartment during the entire time it is being processed in the trough.

Although it is not specifically shown, the drive mechanism for the cleated belt 21*b* preferably comprises an intermittently operating, positively indexing drive such as a Geneva drive, ratchet drive or the like. This drive should be such as to cause the belt to move intermittently from the upstream end 18*b* toward the downstream end 20*b*, pausing whenever a cleat is positioned at the near edge of the container 78*b*. FIGS. 6 and 8 show the belt in such a paused position with the cleat 152 indexed opposite the inner edge of the container 78*b*. As shown in FIG. 8, the container may be provided with a back stop plate 164 to ensure that articles are not thrown beyond the container 162 as they leave the trough 10*b*.

The cleated belt embodiment includes oscillator means, scale means and packaging means of the type previously described in conjunction with FIG. 2. The oscillator means serves as a propulsion means for moving the articles downstream through the trough, and into contact with the downstream cleat of the batch-containing compartment. A standard sequencing means (not shown) is programmed to control the activation of the drive means, scale means, and packaging means. According to a preferred program, the scale means deposits one weighed batch in each compartment; the drive means runs the belt intermittently and stops it at the proper locations; and the packaging means receives and wraps the articles in the same batches originally deposited by the scale means.

c. Feed Mechanism

Referring to FIGS. 7 and 8, a mechanism is shown for partially prealigning articles and feeding them into any of the previously described alignment apparatuses. The mechanism includes a dump scale 172 positioned over a conveyor 174. The conveyor is positioned to carry articles to and deposit them in a feed trough 176, which is positioned perpendicular to the longitudinal axis of the processing trough 10*b* with one of its ends beneath the conveyor 174 and the other of its ends above the upstream end 18*b* of the trough 10*b*. The feed trough 176 is operably connected to an oscillator feeding means (not shown) which vibrates the feed trough 176 to feed articles therein toward the processing of trough 106. The floor of the feed trough includes longitudinal grooves which tend to turn articles perpendicular to the longitudinal axis of the processing trough 10*b*.

Due to the relatively slow operation of most dump scales as compared to the operation of the form and fill machines, the most preferred embodiment of this feed mechanism includes a second dump scale, conveyor 174' and feed trough 176'. Both conveyors 174, 174' operate continuously and rapidly as compared to the speed at which articles moving through the trough 10*b*. The two dump scales are programmed to alternate so that batches of fries are fed at timed intervals to the upstream end 18*b* of the trough 10*b* from the feed troughs 176 and 176'.

Operation

Each of the different embodiments of the present invention operates in a similar manner to align multiple elongated articles. In each case parallel alignment is accomplished by bringing the articles of a batch into contact with a barrier surface positioned transverse to the longitudinal axis of the trough through which the articles are moving.

First, a batch of articles is deposited in a loose array on the floor 16 at a point adjacent the upstream end 18 of the trough 10. Next the batch is moved through the trough toward the downstream end 20. Eventually the articles are projected against a first downstream barrier (28 in FIG. 1 or 158 in FIG. 6), and thereby pivoted toward an orientation parallel to the barrier. After the articles become logjammed against a barrier so that they cease to pivot toward parallel orientation, they are dispersed along the longitudinal axis of the trough without substantially altering their angular orientation, so that they will have more room to pivot when again brought into contact with a barrier surface. Preferably the articles are alternately bunched up and dispersed several times during movement through the trough until all the articles lie substantially parallel to the barrier surfaces and each other. When the articles reach the downstream end 20, they are received by the forming tube of an appropriate vertical form and fill packaging machine 76 and then wrapped while in the improved alignment which resulted from their movement through the trough 10. In the illustrated embodiments, a batch of the articles falls off the downstream end 20 of the trough 10 into a container 78 which maintains the articles in a substantially parallel orientation until the packaging machine 76 receives the batch and forms a folded paper or foil package around it. Vibrating the container 78 further reduces the batch volume prior to wrapping.

A variety of factors may be adjusted to obtain any desired degree of parallel orientation for any given elongated product. These factors include the batch size, the amplitude and frequency of trough oscillation, the number and spacing of barrier surfaces, retention time of articles at each position in the trough, inclination of the trough and, if a belt is used, the speed of the belt. In choosing the optimal operating parameters it is necessary to balance the improvement in packaging quality against the increased costs of operating and constructing packaging production equipment.

FIG. 9 illustrates schematically the range of possible orientations which can be achieved using the present invention. In this figure three identical containers 120, 122, 124 each contain an equal weight of similar elongated articles. If a batch of elongated articles is deposited in a container directly from a scale means or from the end of a standard conveyor belt, the orientation of articles received in the container will be substantially random. Such randomly oriented articles will appear as the articles in the container 120. If the apparatus of the present invention is adjusted to partially optimize the orientation of the articles according to the most economical mode of operation, a batch of articles may appear similar to the batch in the container 122. In this batch a large portion of articles lies horizontally in the center of the container and small portions of the articles lie substantially vertically at the opposite sides of the container. Assuming that economic factors are not important or that total horizontal orientation is mandatory, all the conditions may be optimized for maximum parallel orientation. A batch processed under such optimal conditions would be oriented as is the batch in the container 124, i.e., all the articles would be substantially horizontal. As is clear from FIG. 9, the volume occupied by a batch is a function of its randomness of orientation. The randomly ordered batch in container 120 occupies a substantially greater volume than do either the partially oriented batch in the container 122 or the optimally oriented batch in the container 124 which occupies the least volume.

a. Movable Gates

The various embodiments of the present invention operate differently in some respects. In those embodiments which incorporate movable gates as barrier surfaces (FIGS. 1, 2, 4, 5), a weighed batch of articles is first deposited on the floor 16 near the first end 18 of the trough 10. The articles are moved to a position of abutment with the first downstream gate (28 in FIG. 1) which is thereafter moved to the open position. The batch is next moved beneath the first gate and on toward the second downstream gate (29 in FIG. 1). As it moves between gates, the batch is dispersed by action of the oscillator means. This process is repeated until the batch has alternately been bunched up behind, subsequently allowed to move through, and be dispersed between each gate of the series.

The proper actuation timing of dump scales, gates and packaging machines is important to the efficient operation of the movable gate embodiments. For instance, when operating with an embodiment which includes a moving belt floor, it was observed that a momentary pause in belt motion just prior to the time of gate opening somewhat improves the degree of orientation. If the belt is run continuously, the overall processing time is shorter but randomness is increased. A suggested timing program which minimizes randomness by intermittent belt movement appears in Table I. This program was designed for use with the three gate apparatus shown in FIG. 1.

TABLE I

| | Time interval | | | | | | |
|---|---|---|---|---|---|---|---|
| Station | 1 | 2 | 3 | 4 | 5 | 6 | 7 |
| Dump scale | x | | | | | | |
| First gate actuator | | | | x | | | |
| Second gate actuator | | | | | | x | |
| Third gate actuator | | | | | | | x |
| Belt drive motor | | x | | x | | x | x |
| Trough oscillator | | x | x | x | x | x | x |

x = activated (gate actuators move gates to the open position when activated).

Although not shown in Table I, it is usually desirable that more than one batch be processed simultaneously. This can be accomplished by reactivating the scale dump at about the time that the second gate actuator is activated so that a second batch starts down the trough before the prior batch has arrived at the trough's second end. When multiple batches are being processed, the sequence is set so that, prior to the opening of a gate behind which a batch is amassed, the compartment downstream of a gate is emptied.

When an apparatus of the type shown in FIG. 1, i.e., a three gate vibrating trough with a moving belt floor, tests were conducted to determine the effect various parameters had on the orientation of articles processed in a movable gate embodiment. Standard batches of elongated wooden pegs, having a shape and size selected to simulate frozen french fries, were processed by the apparatus and collected in standard containers. The degree of randomness was determined by the height to which a given batch filled a standard container after processing in the trough. In a trough approximately six inches deep having three gates spaced 20 inches apart and a movable belt floor, numerous test runs were conducted with the gates timed to open at intervals of 4 to 6 seconds, the belt operating at 90 to 180 feet per minute and a reciprocating drive means with a cam having an eccentricity of 3/16 inches operating at 800 to 900 cycles per minute. In these runs, a standard 1000 gm batch of simulated frozen french fries filled a standard container to an average height of 7.5 inches. This represents twento-two percent (22%) less volume than was occupied by unoriented batches which filled identical containers to an average height of 9.7 inches.

The average height of the batches was not substantially altered by variations in the above mentioned operating parameters within the ranges stated. Slightly reduced average volumes were produced when operating near the upper end of the range of belt speeds. Somewhat improved orientation also occurred when the gates were opened at less frequent intervals (6 sec.). When operating at the higher belt speeds (150, 180 fpm.), a somewhat greater reduction in randomness was achieved when the reciprocating drive means operated at a slower rate (800 cpm.); whereas at lower belt speeds (90, 120 fpm.), a somewhat greater reduction in randomness occurred when the reciprocating drive means operated at a faster rate (900 cpm.).

In further tests it was determined that batch size had the greatest effect on randomness. By dividing standard batches into subbatches, separately processing the subbatches, then collecting them in a common container beneath the second end of the trough, it was determined that randomness increases as function of size of the subbatches. If the subbatches were small enough, the reassembled batch in the common container appeared similar to the batch in container 124 of FIG. 9. The use of subbatches does, of course, substantially increase the batch processing time.

The movable gate embodiment of the present invention can, if desired, be modified to process multiple small subbatches by providing a dribble feed mechanism at the downstream end of the trough 10 to deposit aligned articles into a hopper associated with a check weigher (not shown). After a sufficient number of subbatches are processed and collected in the hopper to make up a standard batch, the weigher would trigger the packaging machine to wrap the contents of the hopper. This is one manner in which the apparatus of the present invention can be adapted to produce optimally oriented standard batches in those instances where optimum orientation is a necessity.

b. Cleated Belts

In the operation of a cleated belt embodiment, such as the apparatus shown in FIG. 6, a batch of articles is retained in a compartment defined by two adjacent cleats during its entire travel through the trough **10*b*. A batch is first deposited in a compartment C defined near the upstream end 18*b* of the trough by the cleats 157, 158. The trough is then oscillated to feed articles toward its downstream end while the belt is maintained stationary in relation to the trough. As the articles are propelled into contact with the first downstream cleat 158, they tend to turn into alignment with the cleat. After substantially all the articles have bunched up against the cleat and are thus partially aligned, the belt is moved one increment through the trough 10*b* towards its downstream end 20*b*. According to the embodiment of FIG. 6, the cleat 158 would be moved to the position previously occupied by the cleat 159** during each incremental movement of the belt. During each such incremental movement, articles which were bunched against a downstream cleat are dispersed without substantially changing their parallel orientation. This dispersion occurs because the articles are in a state of rest and persist in that stage as the belt accelerates out from under them. Eventually, however, friction with the belt imparts momentum to the articles causing them to move toward the downstream end of the trough. Because momentum is not imparted to all articles at the same rate, they spread out longitudinally by the time that the belt stops at a new position.

After the belt stops, oscillation of the trough again feeds the articles downstream until they bunch up behind the same cleat. In this manner, as the cleated belt moves through the trough, a batch is alternately bunched up against and dispersed behind that cleat which defines the downstream end of the batch-containing compartment. When the compartment reaches the downstream end **20*b* of the trough 10*b*, the belt stops at a position such that the downstream compartment-defining cleat is located below the end of the trough (at the position occupied by the cleat 152 in FIGS. 6 and 8). As the downstream compartment-defining cleat moves to this position, the batch in the compartment is dropped into the container 78*b* which is positioned at the downstream end 20*b* of the trough 10*b***.

Reducing batch size, increasing the number of stop positions for the belt, and increasing the stop time at each position each increase the degree of parallel orientation obtainable from a cleated belt apparatus. Each, however, increases the required processing time and/or requires increased capital investment in processing equipment. In tests of a cleated belt alignment apparatus, improvements in the alignment of simulated frozen french fries were comparable to those achieved with the movable gate embodiment previously described. These tests also demonstrated that the amount of stop time the cleated belt spent at each position had a large effect on the extent of article orientation. When sufficiently long stop times were allowed, substantially complete orientation was obtained, but the overall processing time was increased.

c. Feed Mechanism

In operation of the feed mechanism, the dump scales deposit batches of articles onto the high speed conveyors 174 and 174' at alternating, times intervals. Because the conveyors operate at a relatively high speed as compared to the processing trough, a batch will be spread over approximately half of the conveyor's total length. The conveyors carry the articles from the scales toward the upstream end 18 of the processing trough 10 and then respectively deposit the articles into their associated feed troughs 176, 176' which lie perpendicular to the processing trough. The feed troughs are oscillated to carry the articles toward the processing trough 10. As they move toward the processing trough, the articles tend to turn parallel to the longitudinal grooves of the feed trough floor and are thus partially aligned parallel to the barrier surfaces even before they are deposited in the processing trough.

If the feed apparatus is used with a movable gate alignment apparatus, the dump scales are programmed to deposit batches on the conveyors at intervals such that a batch moves from a feed trough onto the processing trough 10 at each appropriate stage of the timing program. If used with cleated belt embodiments, the dump scales are programmed such that the feed troughs deposit one weighed batch into each cleatdefined compartment as the belt **21*b*** passes below the feed trough.

While I have shown and described preferred embodiments of my invention, it will be apparent to those skilled in the art that other changes and modifications may be made without departing from my invention in its broader aspects.

I claim:

1. An apparatus for aligning multiple elongated articles comprising:

a processing trough for receiving the articles having a floor extending between upstream and downstream ends of said trough;

at least one barrier located transversely to the longitudinal axis of said trough and positionable therein to divide said trough into separate compartments; and propulsion means associated with said trough for feeding said articles longitudinally therethrough toward said downstream end;

said barrier having a flat surface and being positionable in said trough such that said surface is substantially perpendicular to said floor and faces upstream to form an impact area against which said articles collide and are turned toward parallel alignment as they move toward said surface;

said barrier extending sufficiently close to said floor, whenever so positioned in said trough, that articles can not pass beneath said barrier.

2. Apparatus according to claim 1 wherein said barrier comprises a gate mounted in a fixed position in relation to said trough, said gate being movable between a closed position wherein it prevents longitudinal movement of said article through said trough and an open position wherein it allows such movement.

3. Apparatus according to claim 2 further comprising gate actuator means operable to move said gate between said open and closed positions.

4. Apparatus according to claim 1 wherein said propulsion means comprises oscillator means operably connected to said trough to oscillate said floor and thereby ballistically propel said articles through said trough.

5. Apparatus of claim 4 wherein said oscillator means comprise:

a support base mounted in a fixed position;

a plurality of legs each of which is connected at one end to said trough and at the other end to said base; and reciprocating drive means operably connected between said trough and said support base to oscillate said trough in a vertical plane parallel to the trough axis.

6. Apparatus according to claim 1 wherein:

said floor comprises a plurality of overlapping rigid floor segments positioned in stairstep fashion with the highest floor segment adjacent said upstream end.

7. Apparatus according to claim 6 wherein said barrier is positioned at a point adjacent the lower end of one of said floor segments.

8. Apparatus according to claim 6 wherein:

said propulsion means comprises a plurality of oscillators each of which is operably connected to one of said floor segments to oscillate said floor segments and thereby ballistically propel said articles through said trough.

9. Apparatus according to claim 1 wherein said floor comprises a rigid platform.

10. Apparatus according to claim 1 further comprising a plurality of said barriers positioned to separate said trough into multiple compartments.

11. Apparatus of claim 1 further comprising scale means adapted for depositing, at timed intervals, weighed batches of said articles on said floor at a position adjacent said upstream end.

12. Apparatus of claim 1 further comprising a form and fill packaging machine located at said downstream end to receive and wrap said articles while maintaining them in substantially parallel alignment.

13. Apparatus according to claim 1 further comprising a container positioned adjacent said downstream end of said trough to receive said articles; and an oscillator operably connected to said container for vibrating the same thereby to reduce the volume occupied by articles received by said container.

14. Apparatus according to claim 1 further comprising a container positioned adjacent said downstream end of said trough to receive said articles, said container having one long and one short horizontal interior dimension and being positioned with said long dimension parallel to said surface so that the alignment of articles with said surface is maintained after said articles are deposited in said container.

15. Apparatus according to claim 1 further comprising:

a feed trough positioned above and substantially perpendicularly to said processing trough at said upstream end thereof for feeding articles into said processing trough; and feeding means for moving articles through said feed trough toward said processing trough;

said feed trough having a floor portion with longitudinal grooves which tend to turn articles parallel to said surface as they move through said feed trough.

16. Apparatus according to claim 15 wherein said feeding means comprises an oscillator operably connected to said feed trough to oscillate said longitudinally grooved floor portion and thereby ballistically propel said articles toward said processing trough.

17. An apparatus for aligning multiple elongated articles comprising:

a processing trough for receiving the articles having a floor extending between upstream and downstream ends of said trough, said floor comprising a continuous belt longitudinally movable through said trough from said upstream end toward said downstream end;

drive means operably connected between said belt and a stationary part of said trough for moving said belt through said trough; and at least one barrier located transversely to the longitudinal axis of said trough and positionable therein to divide said trough into separate compartments, said barrier defining a surface against which said articles collide as they move through said trough whereby said articles tend to move into alignment with said surface.

18. Apparatus according to claim 17 wherein said barrier surface comprises a cleat mounted on said belt transversely to said longitudinal axis of said trough.

19. Apparatus of claim 18 further comprising scale means adapted for depositing weighed batches of said articles on said belt at a position adjacent said upstream end.

20. Apparatus of claim 19 further comprising packaging means adapted to receive said articles when they reach said downstream end and to wrap said articles.

21. Apparatus according to claim 17 further comprising oscillator means operably connected to said trough to oscillate said floor and thereby ballistically propel said articles through said trough.

22. An apparatus for aligning multiple elongated articles comprising:

a trough for receiving the articles having a floor extending between upstream and downstream ends of said trough;

said floor comprising a continuous belt longitudinally movable through said trough from said upstream end toward said downstream end;

drive means operably connected between said belt and said trough for moving said belt through said trough;

a plurality of gates mounted transversely to the longitudinal axis of said trough to divide said trough into a plurality of compartments, each of said gates being movable between a closed position wherein it prevents the longitudinal movement of said articles through said trough and an open position wherein it allows such movement, said gates defining barriers against which said articles collide as they move through said trough whereby said articles tend to move into alignment with said gates;

gate actuator means for moving said gates between said open and closed positions;

a support base mounted in a fixed position;

a plurality of legs each of which is connected at one end to said trough and at the other end to said base; and reciprocating drive means operably connected between said trough and said support base to oscillate said trough in a vertical plane which extends parallel to the trough axis and thereby feed said articles toward said gates.

23. An apparatus for aligning multiple elongated articles comprising:

a trough for receiving the articles having a floor extending between upstream and downstream ends of said trough, said floor comprising a continuous belt longitudinally movable through said trough from said upstream end toward said downstream end;

drive means operably connected between said belt and said trough for moving said belt through said trough;

a plurality of cleats mounted on said belt transversely to said longitudinal axis of said trough, said cleats defining barriers against which said articles collide as they move through said trough whereby said articles tend to move into alignment with said cleats;

a support base mounted in a fixed position;

a plurality of legs each of which is connected at one end to said trough and at the other end to said base; and reciprocating drive means operably connected between said trough and said support base to oscillate said trough in a vertical plane which extends parallel to the trough axis and thereby feed said articles toward said downstream end.

24. A process for aligning multiple elongated articles comprising:

depositing a batch of elongated articles onto a surface;

moving said batch along said surface in a predetermined path;

bringing said batch into contact with a flat side of a barrier extending substantially vertically from a location on said surface and substantially perpendicularly to said path whereby the ends of unaligned articles in said batch strike said side and continued movement along said path causes said unaligned articles to turn into parallel alignment with said side;

depositing said aligned articles into a container; and vibrating said container to further reduce the volume occupied by said batch.

25. A process for aligning multiple articles comprising:

depositing a batch of said articles onto the upstream end of a trough which is divided into a series of compartments by multiple transverse barriers;

moving said batch through said trough toward the downstream end thereof; and alternately bunching up said articles of said batch against a downstream barrier whereby said articles tend to move into alignment with said barrier and dispersing the articles in said trough without substantially changing their alignment in relations to said barrier.

26. A process according to claim 25 wherein:

said depositing comprises depositing said batch into a trough wherein said barriers comprise movable gates;

said process further comprises opening each gate at about the time when the articles of the batch are all bunched up against it and thereafter moving said batch downstream past said gate;

said dispersing occurs as said batch moves between gates.

27. A process according to claim 25 further comprising oscillating said trough in a vertical plane which extends parallel to the trough axis to facilitate said moving of said batch through said trough.

28. A process according to claim 25 further comprising:

depositing additional batches of said articles at timed intervals; and removing each said batch from said trough as it arrives at said downstream end.

29. A process according to claim 28 further comprising forming all said batches of a uniform weight prior to their deposition.

30. A process according to claim 28 further comprising wrapping each of said batches after said removing.

31. A process according to claim 28 wherein:

said depositing comprises depositing said batch into a trough wherein said barriers comprise cleats transversely mounted on a continuous movable belt;

said bunching is accomplished by propelling said batch toward the first of said cleats located downstream of said batch; and said dispersing is accomplished by accelerating said belt out from under said batch.

32. A process according to claim 31 further comprising:

depositing an additional batch of said articles behind each cleat as said belt moves past said upstream end; and removing said batches from said trough as they arrive at said downstream end.

33. A process according to claim 32 further comprising forming all said batches of a uniform weight prior to their deposition.

34. A process according to claim 32 further comprising wrapping each of said batches after said removing.

35. A process according to claim 25 further comprising:

prior to said depositing, feeding said articles toward said trough in a feed trough having a longitudinally grooved floor portion disposed parallel to said barriers; and turning at least a portion of said articles parallel to said barriers during said feeding.

36. A process according to claim 25 further comprising:

allowing said batch to drop from the downstream end of said trough into a container; and vibrating said container to further reduce the volume occupied by said batch.

* * * * *